US011753783B2

(12) United States Patent
Kodi

(10) Patent No.: US 11,753,783 B2
(45) Date of Patent: Sep. 12, 2023

(54) GUARD RAIL BARRIER FROM RECYCLED TIRES

(71) Applicant: Jon Kodi, Lebanon, TN (US)

(72) Inventor: Jon Kodi, Lebanon, TN (US)

( * ) Notice: Subject to any disclaimer, the term of this patent is extended or adjusted under 35 U.S.C. 154(b) by 268 days.

(21) Appl. No.: 17/195,838

(22) Filed: Mar. 9, 2021

(65) Prior Publication Data

US 2021/0301485 A1 Sep. 30, 2021

Related U.S. Application Data

(60) Provisional application No. 62/994,077, filed on Mar. 24, 2020.

(51) Int. Cl.
*E01F 15/04* (2006.01)

(52) U.S. Cl.
CPC ..... *E01F 15/0453* (2013.01); *E01F 15/0484* (2013.01)

(58) Field of Classification Search
CPC ..... E01F 15/08; E01F 15/081; E01F 15/086; E01F 15/14; E01F 15/141; E01F 15/145; E01F 15/146; E01F 15/04; E01F 15/0453; E01F 15/0484; E01F 15/0438; E01F 15/0469; E01F 15/0423; E01F 15/043
See application file for complete search history.

(56) References Cited

U.S. PATENT DOCUMENTS 2,603,455 A 7/1952 Welch
3,928,701 A 12/1975 Roehner
3,951,384 A 4/1976 Hildreth, Jr.
4,000,882 A * 1/1977 Penton ..... E01F 9/669 404/9
4,030,706 A 6/1977 Ward
4,057,141 A 11/1977 Laurie et al.
4,095,560 A 6/1978 Laurie et al.
5,156,486 A 10/1992 Davidson
(Continued)

FOREIGN PATENT DOCUMENTS

AU 7791194 A 4/1995
CA 2160584 A1 10/1994
(Continued)

OTHER PUBLICATIONS

Text of FR-2460365-A (Year: 1981).*

*Primary Examiner* — Daniel J Wiley
(74) *Attorney, Agent, or Firm* — Lucian Wayne Beavers; Patterson Intellectual Property Law, PC

(57) ABSTRACT

Elongated protective barrier apparatuses, assemblies and methods of manufacture and installation, are provided that utilize strips of recycled tire tread for attachment within an elongated recess of a guardrail. The elongated recess includes a base, first and second outwardly tapered walls, a minimum width defined between the outwardly tapered walls and an outer opening opposite the base. The elongated protective barrier includes a base layer and a plurality of additional layers sequentially stacked upon the base layer. The base layer includes a first base layer surface having a first base layer width, and a second base layer. The first base layer width is less than or equal to the minimum width. The plurality of additional layers have widths less than that of the elongated recess and are configured to substantially fill the recess at least up to, if not beyond, the outer opening.

24 Claims, 12 Drawing Sheets

(56) References Cited

U.S. PATENT DOCUMENTS

| | | | | |
|---|---|---|---|---|
| 5,229,183 | A | 7/1993 | Eastman | |
| 5,236,756 | A | 8/1993 | Halliburton | |
| 5,238,228 | A | 8/1993 | Moon | |
| 5,284,326 | A | 2/1994 | Chiovitti | |
| 5,285,616 | A | 2/1994 | Tripp | |
| 5,340,630 | A | 8/1994 | Tripp | |
| 5,412,921 | A | 5/1995 | Tripp | |
| 5,429,449 | A | 7/1995 | Baatz | |
| 5,472,750 | A * | 12/1995 | Miller | B29C 53/16 156/95 |
| 5,588,538 | A | 12/1996 | Rundle et al. | |
| 5,613,798 | A | 3/1997 | Braverman | |
| 5,718,166 | A | 2/1998 | Phillips | |
| 5,755,528 | A | 5/1998 | Kulp et al. | |
| 5,834,083 | A | 11/1998 | Pignataro, Jr. | |
| 5,915,880 | A | 6/1999 | Nordberg | |
| 6,258,193 | B1 | 7/2001 | Coffin | |
| 6,306,484 | B1 | 10/2001 | Bove et al. | |
| 6,372,069 | B1 | 4/2002 | Walls | |
| 6,604,888 | B2 | 8/2003 | Dolan | |
| 6,670,003 | B1 | 12/2003 | Schmeling | |
| 6,692,047 | B1 | 2/2004 | Solon | |
| 7,186,449 | B1 | 3/2007 | Hansen | |
| 7,257,875 | B2 * | 8/2007 | Masinelli | E01F 15/0423 256/29 |
| 8,434,965 | B2 | 5/2013 | Chae | |
| 10,590,616 | B1 | 3/2020 | Kodi | |
| 2003/0010421 | A1 | 1/2003 | Coffin et al. | |
| 2005/0152743 | A1 | 7/2005 | Kasraie | |
| 2007/0140790 | A1 | 6/2007 | Lotsberg | |
| 2007/0187661 | A1 * | 8/2007 | Cheng | E01F 15/0453 256/19 |
| 2009/0266472 | A1 | 10/2009 | Martinez-Alvaro et al. | |

FOREIGN PATENT DOCUMENTS

| | | | |
|---|---|---|---|
| CA | 2124401 | A1 | 11/1995 |
| CH | 618488 | A5 | 7/1980 |
| DE | 4116317 | A1 | 11/1992 |
| DE | 4320722 | A1 | 2/1994 |
| DE | 9313884 | U1 | 3/1995 |
| ES | 2191517 | A1 | 9/2003 |
| FR | 2460365 | A1 | 1/1981 |
| FR | 2754553 | A1 | 4/1998 |
| SE | 502091 | C2 | 8/1995 |
| WO | 9417246 | A1 | 8/1994 |

* cited by examiner

GUARD RAIL BARRIER FROM RECYCLED TIRES

The present application claims priority to U.S. Provisional Application Ser. No. 62/994,077 filed on Mar. 24, 2020, which is incorporated herein by reference.

BACKGROUND

1. Field of the Invention

The present invention relates generally to a protective rubber barrier for attachment to an existing sheet metal highway barrier. More particularly, this invention pertains to a protective rubber barrier made from layers of recycled tire treads configured to be coupled within an elongated recess of the existing sheet metal highway barrier.

2. Description of the Prior Art

Guardrails are traditionally seen along the sides of interstate roadways. Interstate guardrails typically have a guardrail face formed from sheet metal. Such guardrails are designed to redirect a vehicle that has lost control or merely drifted off the roadway back onto the roadway in order to avoid accidents with oncoming traffic. Guardrails may also be used in parking structures and other locals as barriers to protect structures and/or people. The guardrail can cause extensive damage to a vehicle upon the interaction between the vehicle and the guardrail, even at low speeds. The damage caused by be guardrail may be caused by the material from which the guardrail face is formed, which is typically sheet metal. Sheet metal guardrails can cut into and damage a given vehicle with ease. Interstate guardrails may have many guardrail faces connected in series at overlapping connection points. When a connection point fails, the resultant free end of the guardrail face may cause even greater damage to a vehicle, in some instances, even skewering the vehicle and potentially harming the driver and passengers thereof.

The reported recycling rate of tires in 2012 was 44.6%. In recent years, many states have banned whole tires from entering landfills. In some of such states, the tires must be at least quartered prior to sending them to a landfill. Uses for old tires have been found to solve this problem including grinding up the rubber for use as mulch in playgrounds. Used tires numbering in the hundreds of millions per month in the United States must be processed and preferably at least partially recycled.

BRIEF SUMMARY

Two substantial needs are present within the prior art. The first is a need to reduce the amount of damage caused to a vehicle by a guardrail when the vehicle interacts with the guardrail (i.e., hits or sideswipes). The second is a need to utilize recycled rubber from vehicle tires.

The present invention addresses both needs by providing a protective barrier and a protective barrier assembly which utilizes strips of recycled tire treads for attachment to existing guardrails. The protective barrier may extend beyond the guardrail such that a vehicle will interact with the protective barrier rather than the metal guardrail face. The invention provides many benefits, such as reducing the damage to a vehicle caused by the interaction between the vehicle and the guardrail and providing increased frictional braking to slow the vehicle down. Another benefit of the invention is that it covers and reinforces the overlapping connection points between the many guardrail faces of a guardrail, thus reducing the likelihood of failure. Additionally, the invention provides environmental benefits by providing a use for used or scrap tires.

One aspect of the embodiments disclosed herein is an elongated protective barrier configured to be attached within an elongated recess of a guardrail. The elongated protective barrier comprises a base layer and a plurality of additional layers sequentially stacked upon the base layer. The base layer has a first base layer surface and a second base layer surface. The first base layer surface has a first base layer surface width that is less than or equal to one-and-one-half (1.5) inches. The second base layer surface has a second base layer surface width that is greater than or equal to the first base layer surface width. Each layer of the plurality of additional layers includes a first surface facing the second base layer surface and further has a first surface width that is greater than the first base layer surface width.

In certain embodiments of the elongated protective barrier in accordance with this aspect, each layer of the plurality of additional layers may include a second surface positioned opposite the first surface. In accordance with this embodiment, the second surface of each of the plurality of additional layers may include a second surface width that is greater than the second base layer surface width.

In certain embodiments of the elongated protective barrier in accordance with this aspect, the first surface width of a given layer of the plurality of additional layers may be greater than the first surface width of a preceding layer of the plurality of additional layers. Further in accordance with this embodiment, the second surface width of the given layer of the plurality of additional layers may be greater than the second surface width of a preceding layer of the plurality of additional layers.

In certain embodiments of the elongated protective barrier in accordance with this aspect, the second surface width of each of the plurality of additional layers may be less than or equal to seven (7) inches.

In certain embodiments of the elongated protective barrier in accordance with this aspect, the second surface width of a given layer of the plurality of additional layers may be greater than the first surface width of the given layer of the plurality of additional layers.

In certain embodiments of the elongated protective barrier in accordance with this aspect, the second surface width of a given layer of the plurality of additional layers may be equal to the first surface width of the given layer of the plurality of additional layers.

In certain embodiments of the elongated protective barrier in accordance with this aspect, the base layer and the plurality of additional layers stacked upon the base layer may define a height that is less than or equal to four (4) inches.

In certain embodiments of the elongated protective barrier in accordance with this aspect, the elongated protective barrier may further comprise an outermost layer configured to rest upon the plurality of additional layers opposite the base layer. In accordance with this embodiment, the outermost layer may have an outermost layer width greater than seven (7) inches.

In certain embodiments of the elongated protective barrier in accordance with this aspect, the elongated protective barrier may further comprise a plurality of fasteners configured to extend through the outermost layer, the plurality of additional layers, and the base layer. In accordance with this embodiment, the plurality of fasteners may further be configured to extend beyond the first base layer surface.

In certain embodiments of the elongated protective barrier in accordance with this aspect, the base layer and the plurality of additional layers stacked upon the base layer may include a plurality of sequential aligned holes defined therethrough. Each hole of the plurality of sequential aligned holes may be configured to receive one of a plurality of fasteners. In accordance with this embodiment, the fastener is configured to extend beyond the first base layer surface.

In certain embodiments of the elongated protective barrier in accordance with this aspect, each hole of the plurality of holes may bisect each respective width of the base layer and the plurality of additional layers stacked upon the base layer.

In certain embodiments of the elongated protective barrier in accordance with this aspect, at least one of the base layer or one or more of the plurality of additional layers is formed from strips of recycled tire tread.

In certain embodiments of the elongated protective barrier in accordance with this aspect, the elongated protective barrier includes a plurality of clips connected to at least one of the plurality of additional layers or the base layer. The plurality of clips are configured to couple the elongated protective barrier to the guardrail by clipping over and under the guardrail.

Another aspect of the embodiments disclosed herein is a protective barrier assembly comprising an elongated channel, a plurality of layers of rubberized material positioned in the elongated channel, and a plurality of fasteners for coupling the plurality of layers to the elongated channel. The elongated channel includes an elongated base having a minimum width, first and second elongated outwardly tapered walls extending from the elongated base, and an outer opening having an outer opening width greater than the minimum width defined between the first and second elongated outwardly tapered walls. The plurality of layers of rubberized material are stacked upon the elongated base. The plurality of layers of rubberized material include a base layer and at least one additional layer stacked upon the base layer. The base layer includes a base layer width that is less than or equal to the minimum width of the elongated base. The at least one layer includes a width that is greater than or equal to the base layer width and less than the outer opening width. The plurality of fasteners are configured to extend through the plurality of layers of rubberized material and are further configured to fasten the plurality of layers of rubberized material to the elongated base of the elongated channel.

In certain embodiments of the protective barrier assembly in accordance with this aspect, the at least one additional layer may include a first additional layer having a first additional layer width and a second additional layer having a second additional layer width. In accordance with this aspect, the first additional layer width may be greater than the base layer width and the second additional layer width may be greater than the first additional layer width.

In certain embodiments of the protective barrier assembly in accordance with this aspect, the width of the at least one additional layer may be constant.

In certain embodiments of the protective barrier assembly in accordance with this aspect, the width of each layer of the at least one additional layer may vary between a first width and a second width. In accordance with this aspect, the first width may be greater than the base layer width and the second width may be greater than the first width.

In certain embodiments of the protective barrier assembly in accordance with this aspect, the plurality of layers of rubberized material may further include an outermost layer extending at least partially beyond the outer opening of the channel.

In certain embodiments of the protective barrier assembly in accordance with this aspect, the outermost layer may include an outermost layer width that is greater than the outer opening width.

In certain embodiments of the protective barrier assembly in accordance with this aspect, at least one layer of the plurality of layers of rubberized material may include at least one strip of recycled tire tread.

In certain embodiments of the protective barrier assembly in accordance with this aspect, the base layer and the at least one additional layer may be formed from strips of recycled tire tread.

In certain embodiments of the protective barrier assembly in accordance with this aspect, the plurality of layers of rubberized material may be connected together using an adhesive.

In certain embodiments of the protective barrier assembly in accordance with this aspect, the plurality of layers of rubberized material may include a plurality of aligned holes spaced along a lengthwise direction of the plurality of layers. Each hole of the plurality of aligned holes bisects respective widths of the plurality of layers of rubberized material. In accordance with this aspect, each hole of the plurality of aligned holes may be configured to receive a fastener of the plurality of fasteners.

In certain embodiments of the protective barrier assembly in accordance with this aspect, the outermost layer may be formed or extruded from ground recycled rubber.

In certain embodiments of the protective barrier assembly in accordance with this aspect, each layer of the plurality of layers of rubberized material may include a respective width that varies according to a variable width of the elongated channel defined between the first and second elongated outwardly tapered walls.

In certain embodiments of the protective barrier assembly in accordance with this aspect, each layer of the plurality of layers of rubberized material may include a first width and a second width. In accordance with this aspect, the first width may be substantially equal to a maximum width of an adjacent preceding layer and the second width may be substantially equal to a minimum width of an adjacent succeeding layer.

DETAILED DESCRIPTION

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 10:
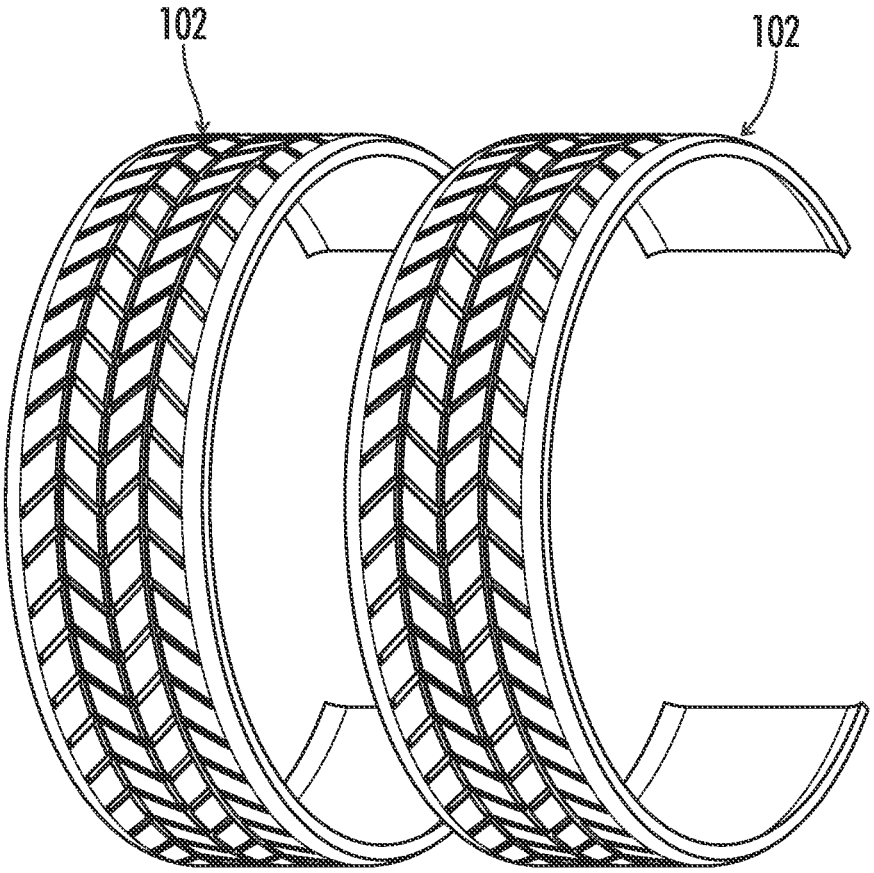
FIG. 10 is a perspective view of strips of tread material cut from a tire.
Figure 11:
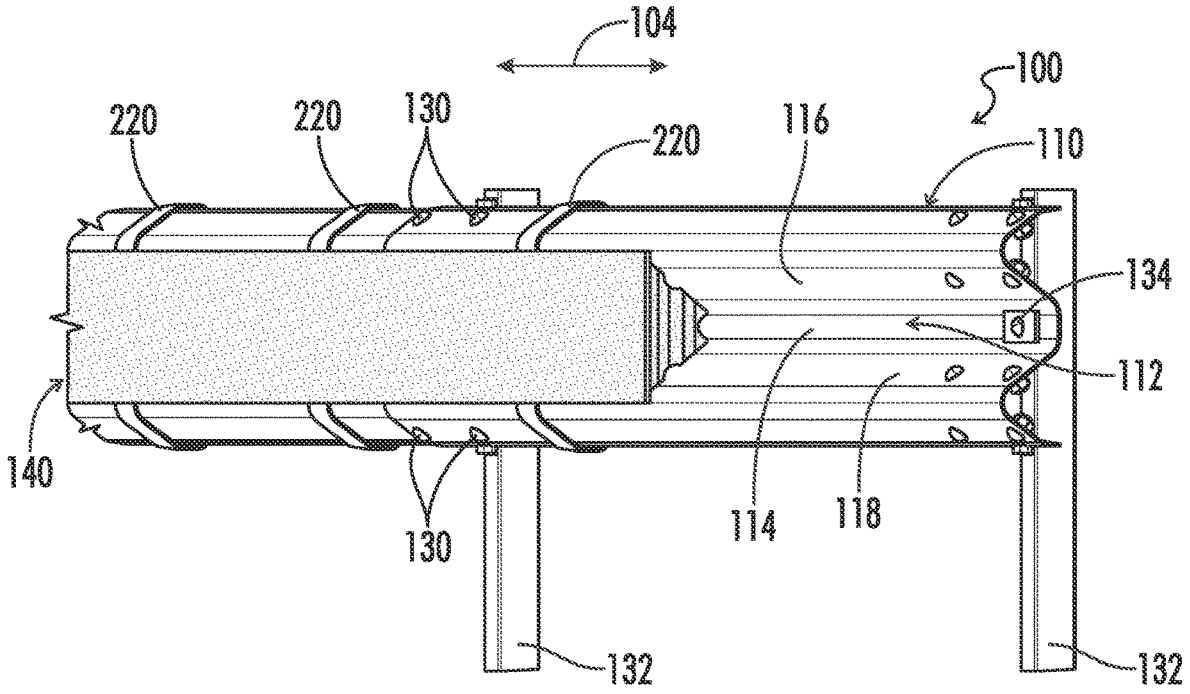
FIG. 11 is a perspective view of the protective barrier assembly of FIG. 1 including a plurality of clips for coupling the elongated protective barrier to the guardrail.

Referring to FIGS. 1-3, 5-6, and 8, a protective barrier assembly 100 is provided. The protective barrier assembly comprises an elongated recess 112 of a guard rail 110 and an elongated protective barrier 140 configured to be attached within the elongated recess 112. The elongated recess 112 may also be referred to herein as an elongated channel 112. The elongated protective barrier is configured to repurpose strips of recycled tire tread 102 (shown in FIG. 10).

Figure 1:
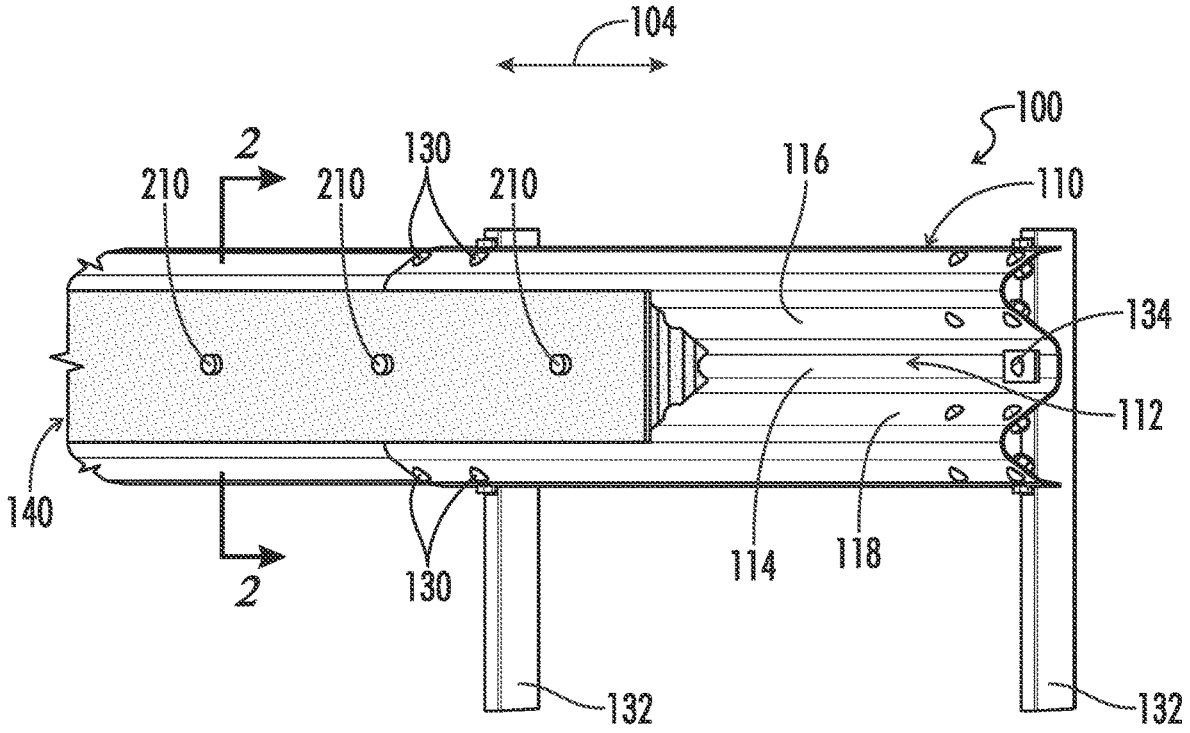
FIG. 1 is a perspective view of a protective barrier assembly in accordance with the present disclosure.
Figure 9:
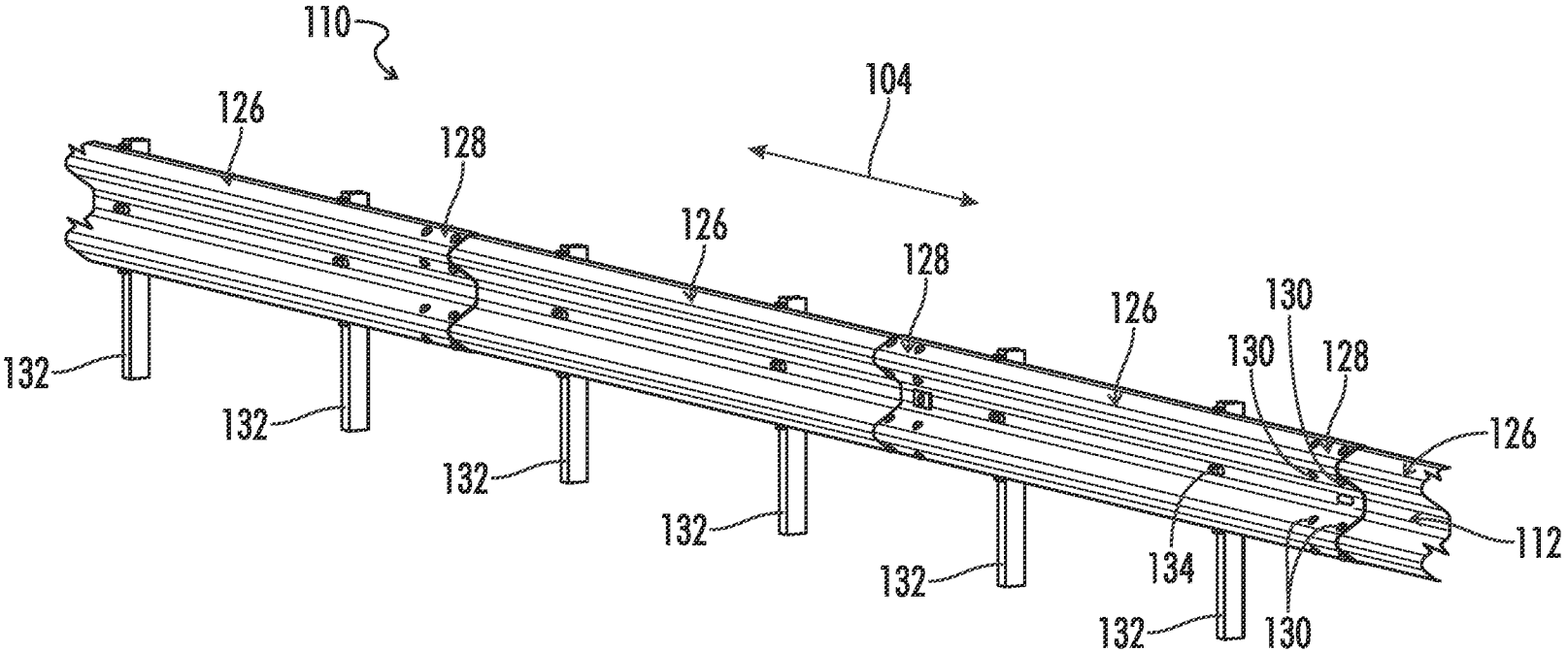
FIG. 9 is a perspective view of a prior art guardrail.

As can best be seen in FIGS. 1 and 9, the elongated recess 112 of the guard rail 110 extends parallel to a lengthwise direction 104. The elongated recess includes an elongated base 114, a first elongated outwardly tapered wall 116 and a second elongated outwardly tapered wall 118, all parallel to the lengthwise direction 104. The first and second elongated outwardly tapered walls extend from the elongated base and define a minimum width 120 of the elongated recess 112 along the elongated base perpendicular to the lengthwise direction. The elongated recess 112 further includes an outer opening 122 having an outer opening width 124 that is greater than the minimum width 120. The outer opening is defined between the first and second elongated outwardly tapered walls opposite the elongated base.

As can best be seen in FIG. 9, the elongated recess 112 includes a plurality of sections 126 connected together and extending parallel to the lengthwise direction 104. Each section of the plurality of sections includes overlapping end portions 128 configured to connect with overlapping end portions of adjacent sections of the plurality of sections 126. The overlapping end portions are bolted together along the first and second elongated outwardly tapered walls 116, 118 using a plurality of connection fasteners 130. Additionally, the elongated base 114 is coupled to a plurality of support posts 132 using a plurality of mounting fasteners 134. The plurality of connection fasteners 130 and the plurality of mounting fasteners 134 may be identical. As can best be seen in FIGS. 2, 3, 5, and 6, the plurality of connection fasteners and the plurality of mounting fasteners may extend slightly within the elongated recess.

As can best be seen in FIGS. 2-8, the elongated protective barrier 140 includes a base layer 142 and at least one additional layer stacked upon the base layer. As illustrated, the at least one additional layer comprises a plurality of additional layers 144 stacked upon the base layer. The base layer includes a first base layer surface 150 and the second base layer surface 152 opposite the first base layer surface. As can best be seen in FIGS. 4 and 7, the first base layer surface includes a first base layer surface width 154. The first base layer surface width may be less than or equal to the minimum width 120 of the elongated recess 112. Alternatively, the first base layer surface width 154 may be less than or equal to one-and-one-half (1.5) inches, the minimum width of typical elongated recesses of guardrails 110. The second base layer surface 152 includes a second base layer surface width 156 that is greater than or equal to the first base layer surface width 154.

The plurality of additional layers 144 (e.g., 144A, 144B, 144C, 144D, etc.) may be sequentially stacked upon the second base layer surface 152 of the base layer 142. Each layer of the plurality of additional layers includes a first surface 160 (e.g., 160A, 160B, 160C, 160D, etc.) and a second surface 162 (e.g., 162A, 162B, 162C, 162D, etc.) opposite the first surface. As can best be seen in FIGS. 4 and 7, the first surface 160 of each of the plurality of additional layers 144 faces the second base layer surface and has a first surface width 164 (e.g., 164A, 164B, 164C, 164D, etc.) that is greater than the first base layer surface width 154. The second surface 162 of each of the plurality of additional layers 144 includes a second surface width 166 (e.g., 166A, 166B, 166C, 166D, etc.) that is greater than the second base layer surface width 156. The second surface width 166 may be less than or equal to the outer opening width 124 of the outer opening 122 of the elongated recess 112. Alternatively, the second surface width of each of the plurality of additional layers may be less than or equal to seven (7) inches, the outer opening width of typical elongated recesses of guardrails 110.

In certain optional embodiments, the first surface width 164 of a given layer of the plurality of additional layers 144 is greater than a first surface width of a preceding layer of the plurality of additional layers. Likewise, and in accordance with this optional embodiment, the second surface width 166 of a given layer of the plurality of additional layers 144 is greater than a second surface width of a preceding layer of the plurality of additional layers. In certain optional embodiments, as can best be seen in FIGS. 5 and 6, at least a pair of adjacent layers of the plurality of additional layers 144 may be identical and thus have common first and second surface widths 164, 166.

Figure 2:
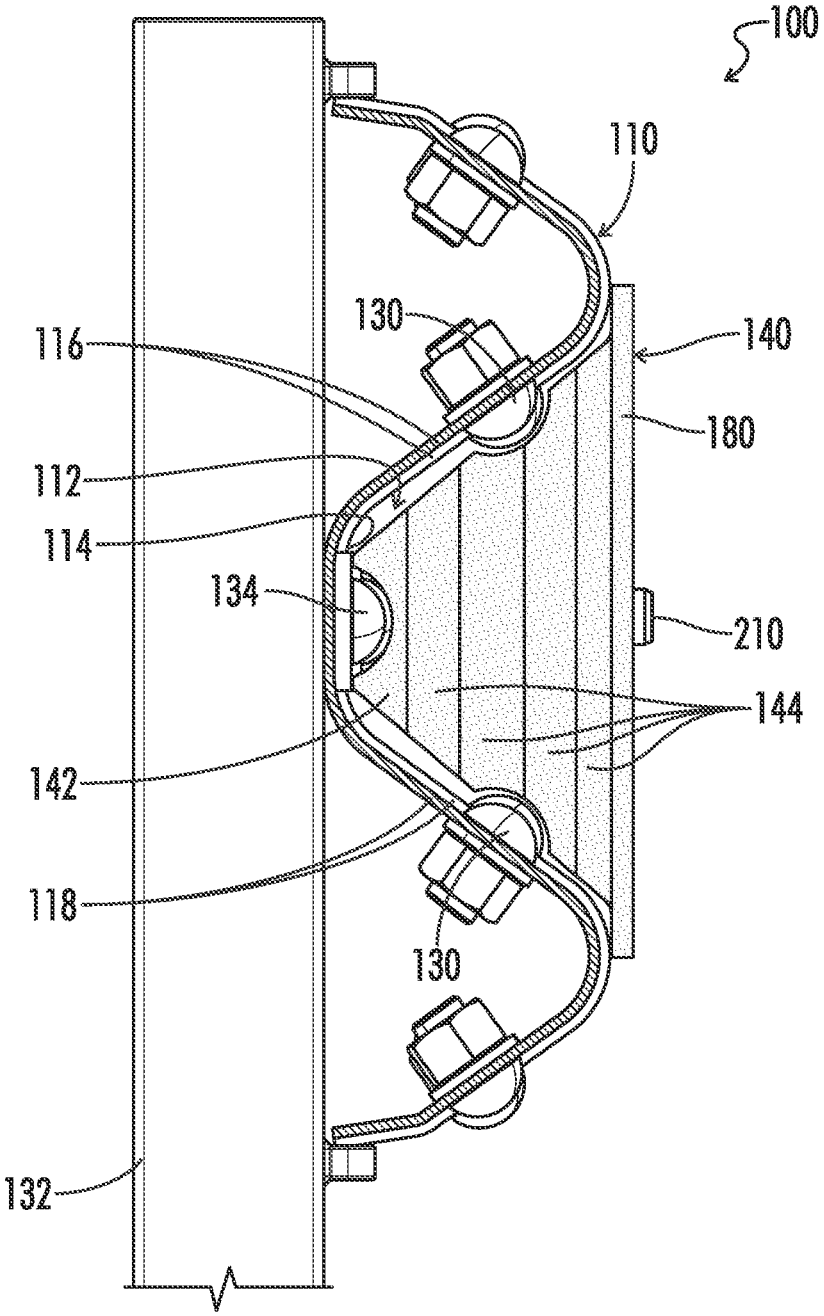
FIG. 2 is a cross-sectional view of the protective barrier assembly of FIG. 1 taken along line 2-2 of FIG. 1.
Figure 3:
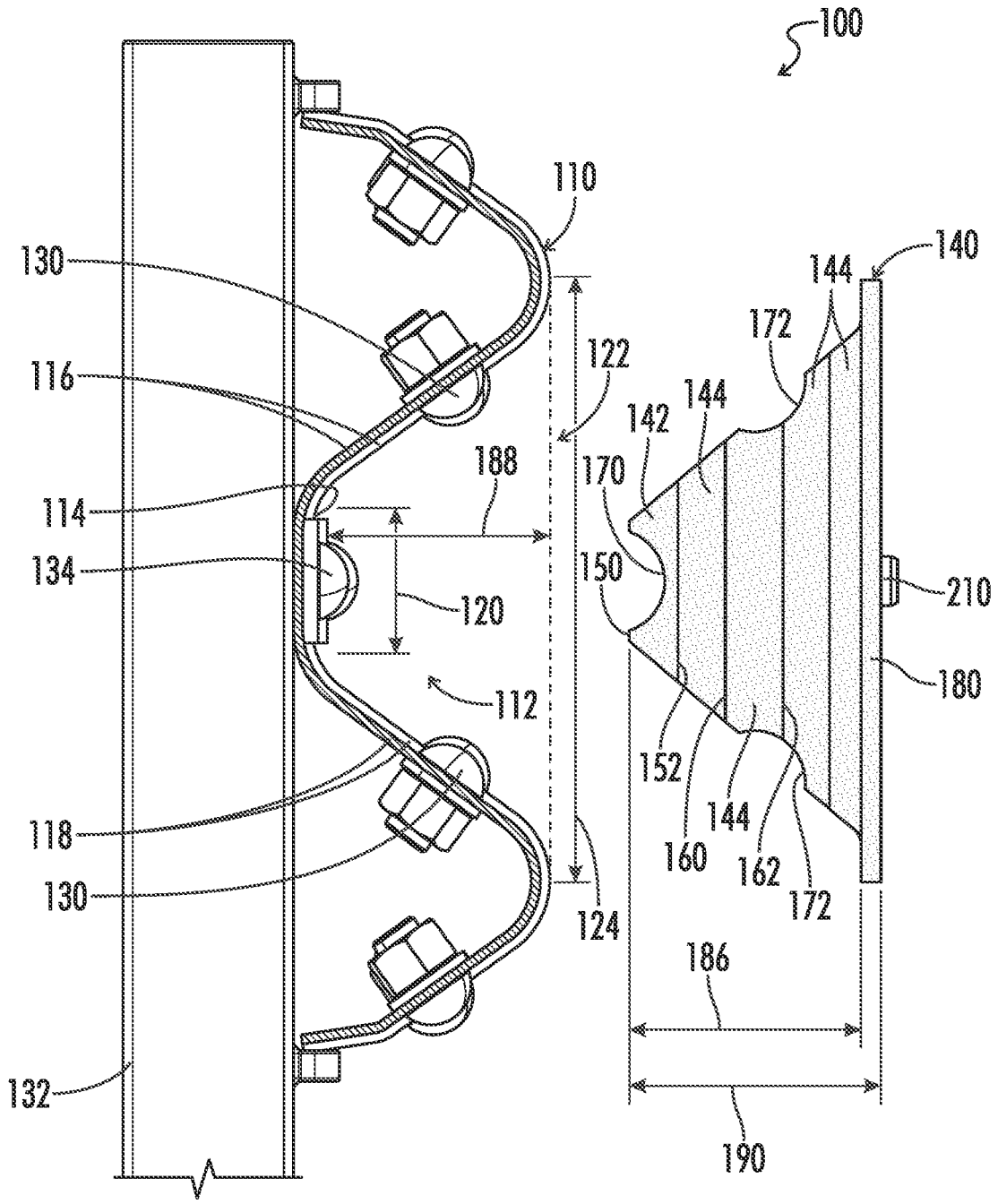
FIG. 3 is an exploded cross-sectional view of the protective barrier assembly of FIG. 1.
Figure 4:
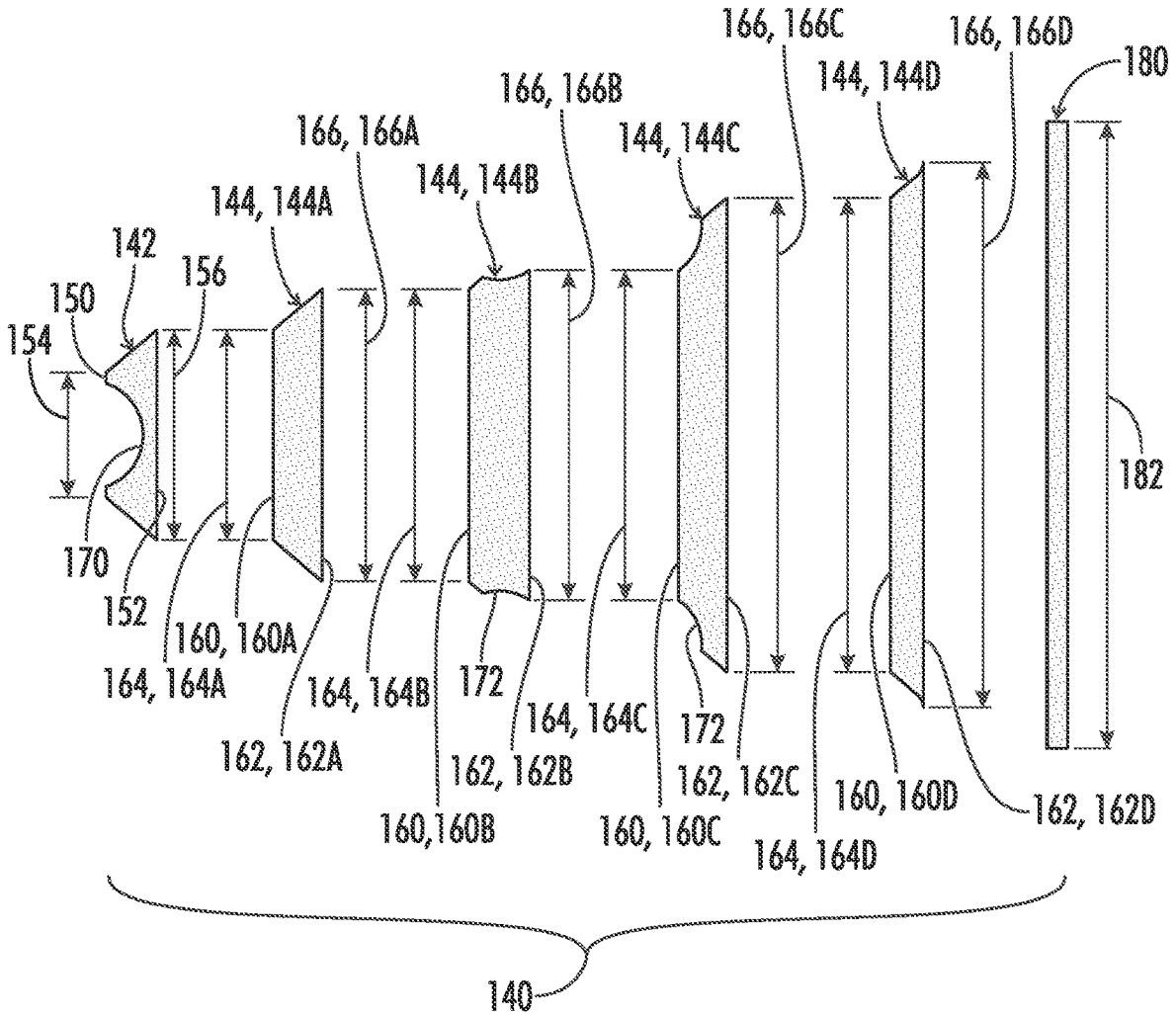
FIG. 4 is an exploded cross-sectional view of an elongated protective barrier of the protective barrier assembly of FIG. 1.

As can best be seen in FIGS. 2-4, the second surface width 166 of a given layer of the plurality of additional layers 144 is greater than the first surface width 164 of the given layer. Additionally, the first surface width of the given layer of the plurality of additional layers may be substantially equal to the second surface width of a preceding layer of the plurality of additional layers. Likewise, the second surface width of the given layer of the plurality of additional layers may be substantially equal to the first surface width of a succeeding layer of the plurality of additional layers.

As illustrated, the first base layer surface 150 may include a base layer recess 170 extending along a length of the elongated protective barrier 140. The base layer recess 170 is configured to accommodate the plurality of mounting fasteners 134 that extend slightly beyond the elongated base 114 into the elongated recess 112. In other optional embodiments (not shown), the base layer recess 170 may comprise a plurality of base layer recesses spaced along the length of the elongated protective barrier 140 corresponding to a spacing between the plurality of mounting fasteners 134. Similarly, at least one of the plurality of additional layers 144 may include an additional layer recess 172 at each ends thereof for accommodating the plurality of connection fasteners 130 which extend slightly beyond the first and second elongated outwardly tapered walls 116, 118 into the elongated recess 112. As illustrated, the additional layer recess 172 defined at each end of at least one of the plurality of additional layers 144 may extend along the length of the elongated protective barrier 140. In other optional embodiments (not shown), the additional layer recesses 172 may be sequentially spaced along the length of the elongated protective barrier corresponding to a spacing of the plurality of connection fasteners 130.

In still further optional embodiments (not shown), rather than having the base layer recess 170 and the additional layer recesses 172, the base layer 142 and the plurality of additional layers 144 may be externally surrounded by a malleable layer of material that is thick enough and malleable enough to accommodate for the pluralities of connection and mounting fasteners 130, 134. In such an embodiment, the first and second base layer widths 154, 156 of the base layer and the first and second surface widths 164, 166 of each of the plurality of additional layers would need to be selected to accommodate for the malleable layer of material.

As can best be seen in FIGS. 5-8, the second surface width 166 of a given layer of the plurality of additional layers 144 is equal to the first surface width 164 of the given layer. The widths of the plurality of additional layers thus define a stair step configuration of the additional layers. Although not shown, the first base layer surface 150 may include a base layer recess similar to that of the embodiment shown in FIGS. 2-4. As can best be seen in FIG. 5, the widths of the plurality of additional layers 144 in the stair step configuration may be selected to accommodate the plurality of connection fasteners 130 extending beyond the first and second elongated outwardly tapered walls 116, 118.

The elongated protective barrier 140 may further include an outermost layer 180 resting upon the plurality of additional layers 144 opposite the base layer 142. The outermost layer includes an outermost layer width 182 that may be greater than the outer opening width 124 of the outer opening 122 of the elongated recess 112. Alternatively, the outermost layer width 182 may be greater than about seven (7) inches, the outer opening width of typical elongated recesses of guardrails 110. Accordingly, the outermost layer width is greater than the second surface width 166 of an outermost additional layer of the plurality of additional layers 144. In certain optional embodiments, the outermost layer width 182 may be between about five (5) and about nine (9) inches. In other optional embodiments, the outermost layer width 182 may be between about three (3) inch and about eleven (11) inches.

Figure 5:
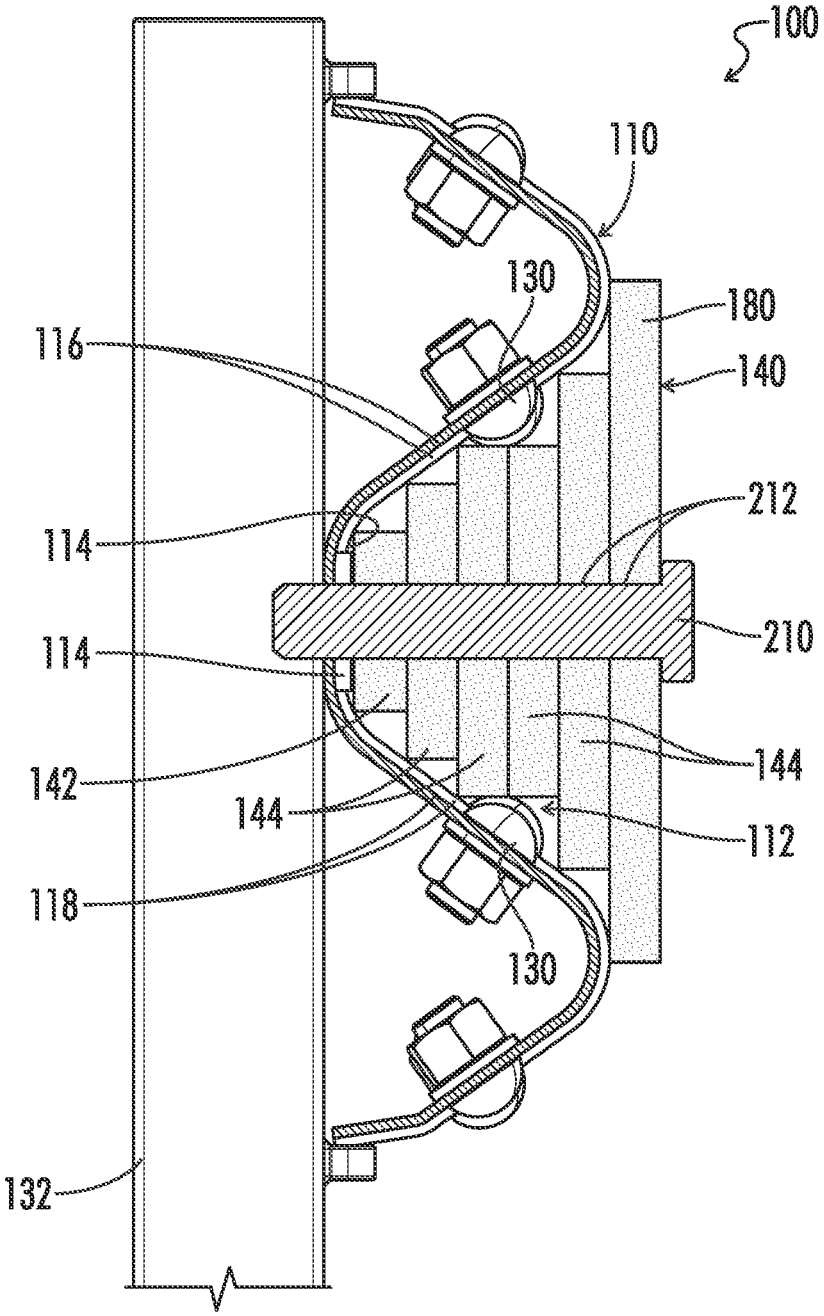
FIG. 5 is a cross-section view of an alternate embodiment of an elongated protective barrier of the protective barrier assembly of FIG. 2 in accordance with the present disclosure.
Figure 6:
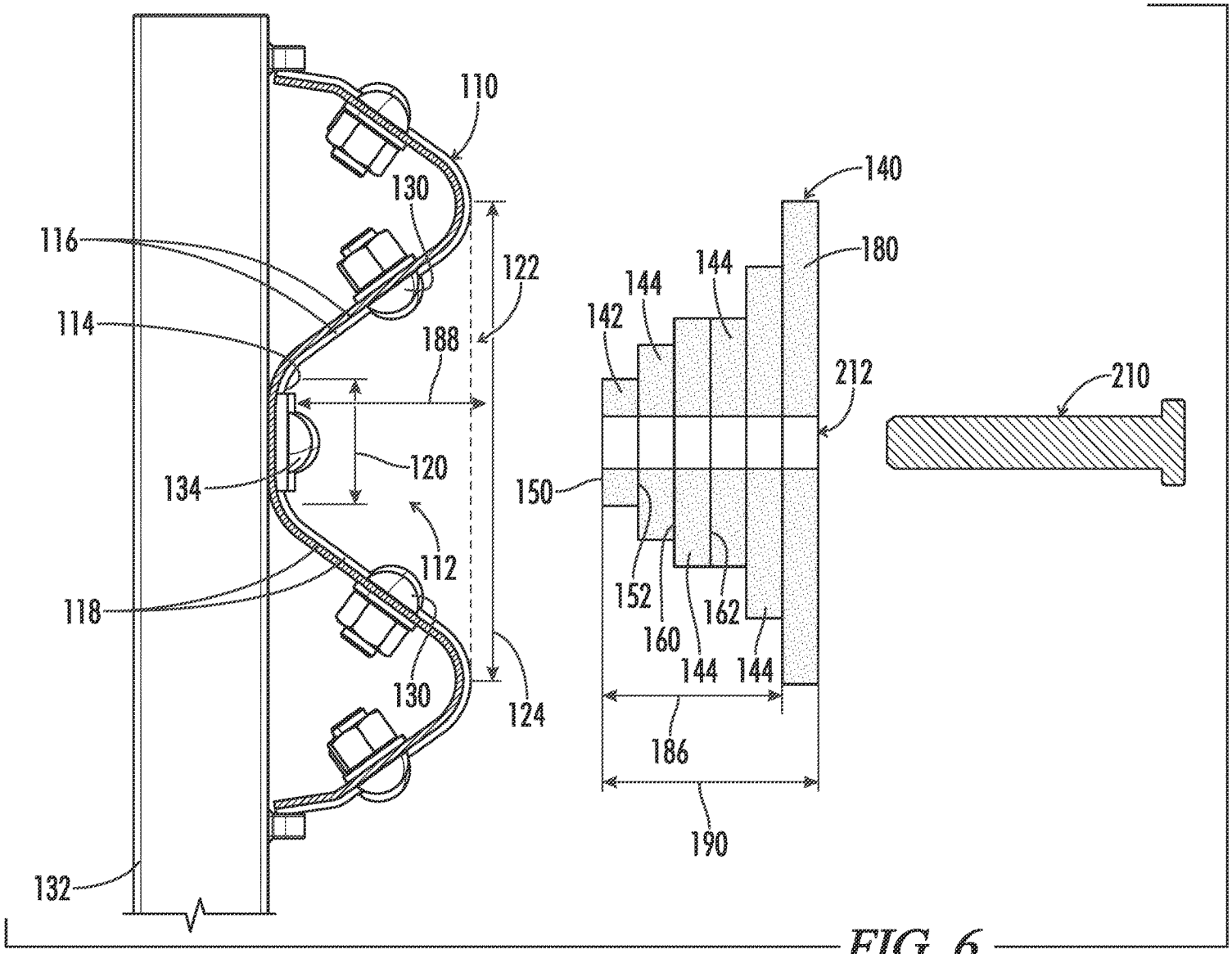
FIG. 6 is an exploded cross-sectional view of the protective barrier assembly of FIG. 5.
Figure 7:
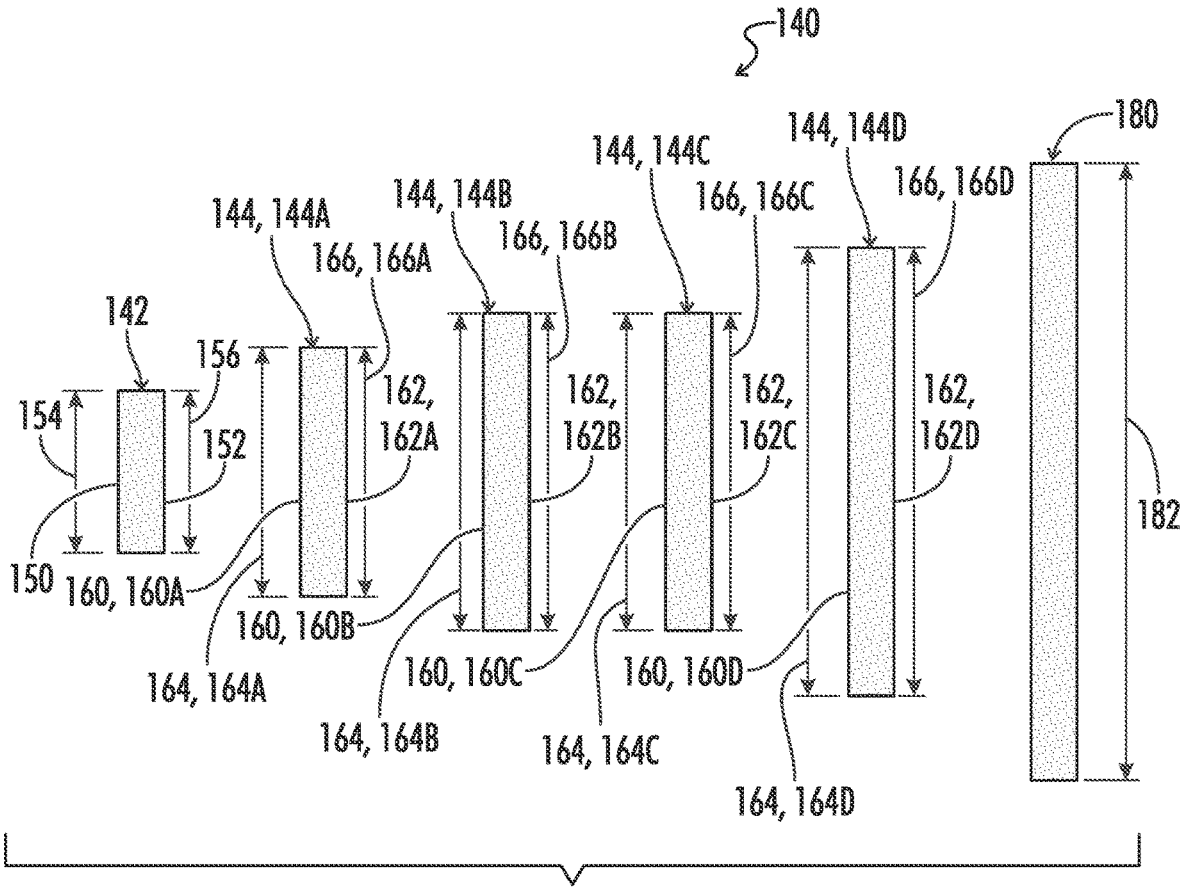
FIG. 7 is an exploded cross-sectional view of the elongated protective barrier of the protective barrier assembly of FIG. 5.

As can best be seen in FIGS. 2 and 5, the base layer 142 and the plurality of additional layers 144 stacked upon the base layer may define a height 186 that is less than or equal to a recess height 188 of the elongated recess 112. The recess height 188 may be defined between the elongated base 114 and the outer opening 182. Alternatively, the height 186 may be less than or equal to about four (4) inches, the recess height of typical elongated recesses of guardrails 110. In certain optional embodiments, the height 186 may be between about three (3) and about five (5) inches. In other optional embodiments, the height 186 may be between about one (1) inch and about seven (7) inches. In still other optional embodiments, the height 186 substantially depends on the recess height of typical elongated recesses of guardrails 110. The outermost layer 180 may be configured to extend at least partially beyond the outer opening 122 of the elongated recess 112. The base layer 142, the plurality of additional layers 144, and the outermost layer 180 stacked together may define a protective barrier height 190. The protective barrier height may be greater than the recess height 188. Alternatively, the protective barrier height may be greater than about four (4) inches.

The base layer 142, the plurality of additional layers 144, and the outermost layer 180 may all be formed from a rubberized material and at least one layer thereof is formed from or incorporates strips of recycled tire tread 102. In other optional embodiments, the base layer 142 and the plurality of additional layers 144 are all formed from or incorporate strips of recycled tire tread 102 into their construction. In order for the outermost layer 180 to have a smooth and finished outer surface (e.g., not rough like that of a recycled tire treats), the outermost layer may be formed from a ground recycled rubber, such as, for example, from recycled tires (not shown), or other recycled plastics and rubbers (not shown). In other optional embodiments (not shown), the outermost layer may be formed from the strips of recycled tire tread 102.

Even though all of the layers 142, 144, 180 of the elongated protective barrier 140 may be formed from the strips of recycled tire tread 102, this does not prevent the use of additional layers of other materials being positioned between various selected layers 142, 144, 180 of the elongated protective barrier 140. Such additional layers of other materials may include stiffeners, thin sheets of metal, recycled plastics or the like. In optional embodiments including recycled plastics between the additional layers of the elongated protective barrier 140, the recycled plastics may act as an impact absorber, for example, including a honey-comb pattern, a ribbed pattern, or the like. In other optional embodiments, other materials may serve as impact absorbers implementing similar crumpleable patterns.

The base layer 142 and the plurality of additional layers 144 may be coupled together using an adhesive. Additionally, the outermost layer 180 may be coupled to an outermost additional layer of the plurality of additional layers using the adhesive. The orientation of the strips of recycled tire tread 102 between adjacent layers may be selected to improve a strength of the adhesive between the layers. Such orientations of the plurality of additional layers may include treadside-to-underside, underside-to-underside and tread-side-to-treadside, or some combination thereof.

The protective barrier assembly 100 may further include a plurality of fasteners 210 configured to extend through the layers 142, 144, 180 of the elongated protective barrier 140 for fastening the layers to the elongated base 114 of the elongated recess 112. As can best be seen in FIGS. 4, 6 and 7, the elongated protective barrier may include a plurality of holes 212 sequentially spaced and aligned parallel with the lengthwise direction 104. The plurality of holes may bisect respective widths of the base layer 142, plurality of additional layers 144, and the outermost layer 180. Each hole of the plurality of holes 212 is configured to receive a fastener of the plurality of fasteners 210. Each fastener of the plurality of fasteners is configured to extend beyond the first base layer surface 150 when received in its respective hole of the plurality of holes.

Figure 8:
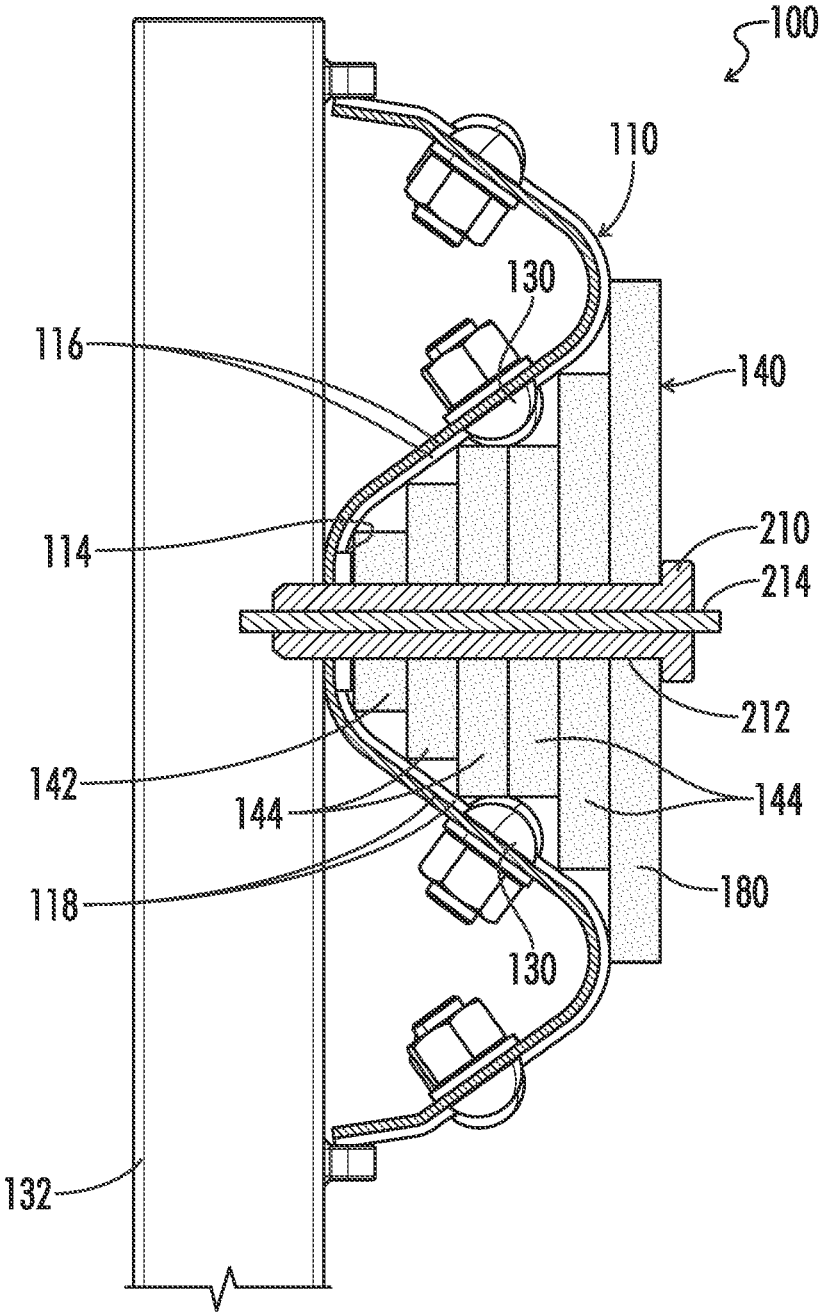
FIG. 8 is a cross-sectional view of the protective barrier assembly of FIG. 5 with a fastener pin positioned through a fastener of the protective barrier assembly in accordance with the present disclosure.

As can best be seen in FIG. 8, each fastener of the plurality of fasteners 210 includes a pin 214 receivable therethrough. The pin is configured to extend through each fastener. In certain optional embodiments, each pin 214 may include a respective cap (not shown) for covering the fasteners so they do not damage vehicles interacting with the protective barrier. The cap may be formed from a rubber or plastic material. In other optional embodiments, the plurality of fasteners 210 may be metal rivets, rubber rivets, gromets, plastic bolts, or the like. In certain optional embodiments, the plurality of fasteners 210 may be counter-sunk into the outermost layer 180 via a pre-drilled hole and then covered with a rubber plug. The elongated protective barrier 140 may be installed to the guardrail 110 using the plurality of fasteners 210.

In certain optional embodiments, as can best be seen in FIGS. 11 and 12A-12D, the elongated protective barrier 140 may be installed to the guardrail 110 using a plurality of clips 220. The plurality of clips 220 may be spaced along the elongated protective barrier 140 and may be shaped such that they clip over the top and under the bottom of the guardrail 110, shown in FIGS. 12A-12D. In certain optional embodiments, the plurality of clips 220 may be formed from strips of sheeted metal or the like. In other optional embodiments, the plurality of clips 220 may be formed from plastic or some other material.

Figure 12A:
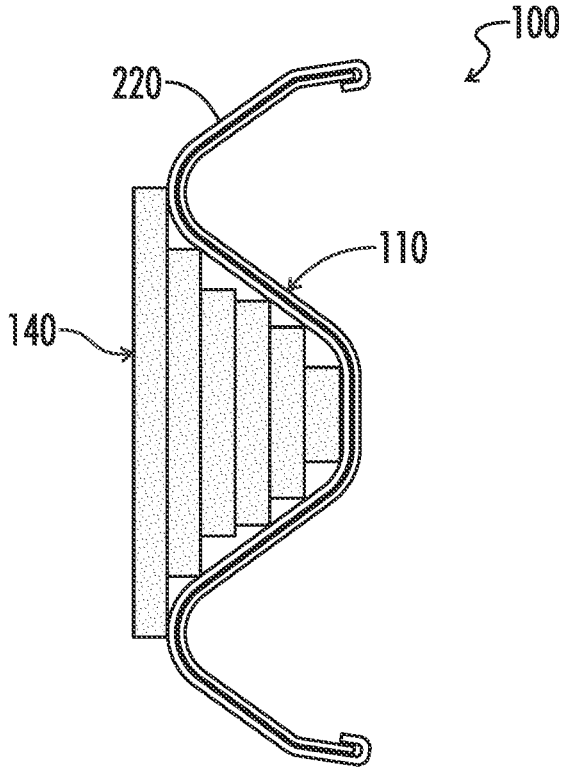
FIG. 12A is a cross-sectional view of the protective barrier assembly of FIG. 11.
Figure 12B:
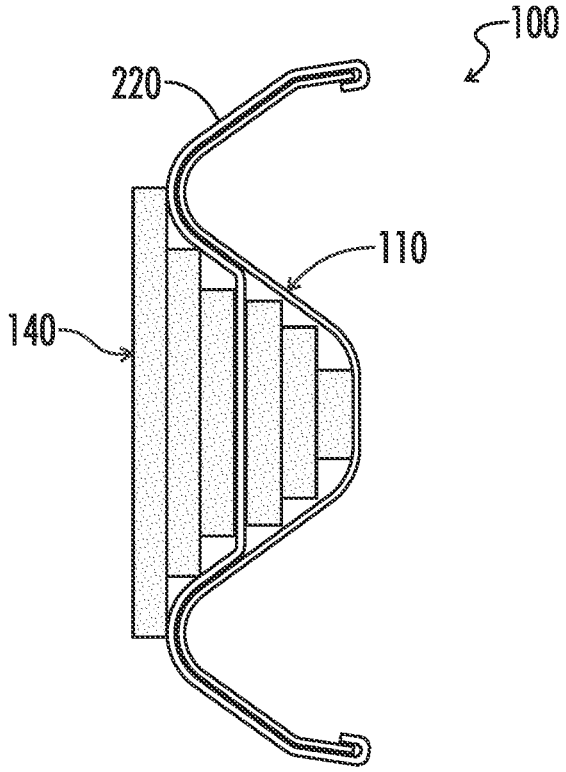
FIG. 12B is a cross-sectional view of an optional embodiment of the protective barrier assembly of FIG. 11.
Figure 12C:
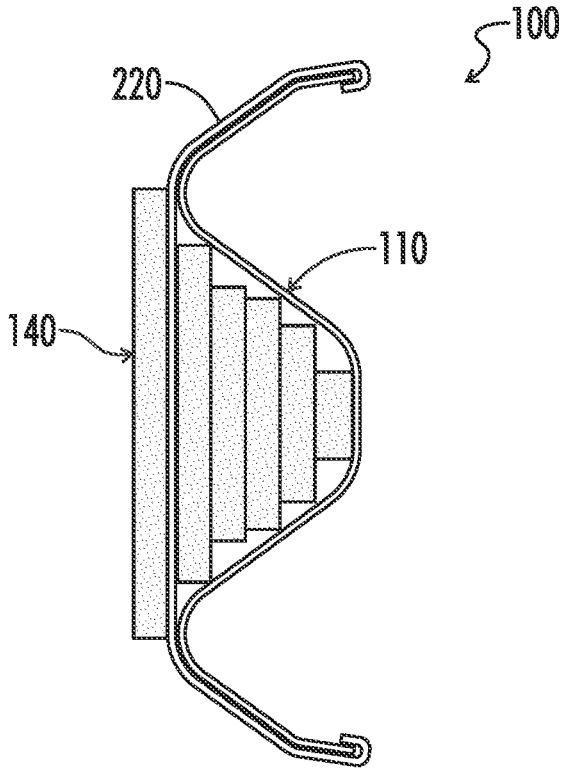
FIG. 12C is a cross-sectional view of an optional embodiment of the protective barrier assembly of FIG. 11.
Figure 12D:
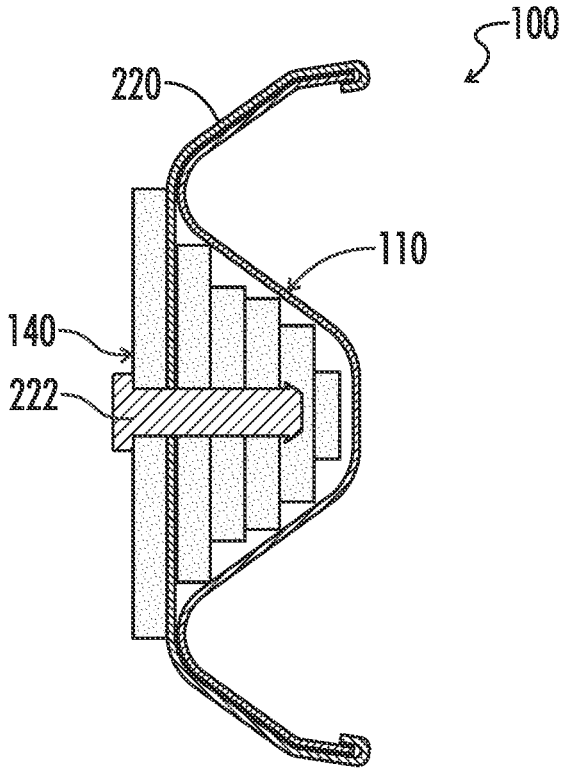
FIG. 12D is a cross-sectional view of an optional embodiment of the protective barrier assembly of FIG. 11.

As can best be seen in FIG. 12A, the plurality of clips 220 may be attached to a rear side of the elongated protective barrier 140 using an adhesive or fastener (not shown). As can best be seen in FIGS. 12B-12C, a central portion of each of the plurality of clips 220 may be sandwiched between any two adjacent layers. For example, as can best be seen in FIG. 12B, the central portion of each of the plurality of clips 220 is sandwiched between two adjacent layers of the plurality of additional layers 144 and is connected thereto using an adhesive, fastener or the like. Further for example, as can best be seen in FIGS. 12C and 12D, the central portion of each of the plurality of clips 220 is sandwiched between the outermost layer 180 and an adjacent one of the plurality of additional layers 144. In certain optional embodiments, the central portion of each of the plurality of clips 220 in FIG. 12C may be coupled to the elongated protective barrier using an adhesive (not shown). In certain other optional embodiments, the central portion of each of the plurality of clips 220 in FIG. 12D may be coupled to the elongated protective barrier using a fastener 222 in additional to or as an alternative to adhesive (not shown). The fastener 222 may be similar to or identical to the plurality of mounting fasteners 134, however, just shorter.

In certain optional embodiments, the protective barrier assembly 100 may be manufactured by layering stripes of recycled tire tread 102 to form each of the base layer 142, the plurality of additional layers 144, and the outermost layer 180. In other optional embodiments, the outermost layer 180 may be formed from ground recycled rubber, such as that from tires, and manufactured using an extrusion technique. The outermost layer 180 made from ground extruded rubber may be layered upon the other layers in a normal fashion, using glue or the like to bind the layers together. In certain other optional embodiments, the entire elongated protective barrier 140 may be manufactured using ground recycled rubber, such as that from tires, and manufactured using an extrusion technique. Any of the base layer 142, the plurality of additional layers 144, or the outermost layer 180 may be formed using ground recycled rubber, such as that from tires, and manufactured using an extrusion technique. In other optional embodiments, each of the layers 142, 144, 180 may be formed from recycled tires using some other manufacturing technique now known or developed in the future.

To facilitate the understanding of the embodiments described herein, a number of terms have been defined above. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful protective barrier, it is not intended that such references be construed as limitations upon the scope of this disclosure except as set forth in the following claims

What is claimed is:

1. An elongated protective barrier configured to be attached within an elongated recess of a guardrail, the elongated protective barrier comprising:

a base layer having a first base layer surface and a second base layer surface, the first base layer surface having a first base layer surface width less than or equal to one-and-one-half (1.5) inches, the second base layer surface having a second base layer surface width greater than or equal to the first base layer surface width;

a plurality of additional layers sequentially stacked upon the base layer, each layer of the plurality of additional layers including a first surface facing the second base layer surface and having a first surface width greater than the first base layer surface width; and wherein the base layer and the plurality of additional layers stacked upon the base layer define a height being greater than four (4) inches.

2. The elongated protective barrier of claim 1, wherein:

each layer of the plurality of additional layers includes a second surface positioned opposite the first surface; and the second surface of each of the plurality of additional layers incudes a second surface width greater than the second base layer surface width.

3. The elongated protective barrier of claim 2, wherein:

the first surface width of a given layer of the plurality of additional layers is greater than the first surface width of a preceding layer of the plurality of additional layers; and the second surface width of the given layer of the plurality of additional layers is greater than the second surface width of a preceding layer of the plurality of additional layers.

4. The elongated protective barrier of claim 2, wherein:

the second surface width of each of the plurality of additional layers is less than or equal to seven (7) inches.

5. The elongated protective barrier of claim 2, wherein:

the second surface width of a given layer of the plurality of additional layers is greater than the first surface width of the given layer of the plurality of additional layers.

6. The elongated protective barrier of claim 2, wherein:

the second surface width of a given layer of the plurality of additional layers is equal to the first surface width of the given layer of the plurality of additional layers.

7. The elongated protective barrier of claim 1, further comprising:

an outermost layer resting upon the plurality of additional layers opposite the base layer;

the outermost layer having an outermost layer width greater than seven (7) inches.

8. The elongated protective barrier of claim 7, further comprising:

a plurality of fasteners configured to extend through the outermost layer, the plurality of additional layers, and the base layer; and the plurality of fasteners further configured to extend beyond the first base layer surface.

9. The elongated protective barrier of claim 1, wherein:

the base layer and the plurality of additional layers stacked upon the base layer include a plurality of sequential aligned holes defined therethrough;

each hole of the plurality of sequential aligned holes is configured to receive one of a plurality of fasteners; and the fastener is configured to extend beyond the first base layer surface.

10. The elongated protective barrier of claim 9, wherein:

each hole of the plurality of holes bisects each respective width of the base layer and the plurality of additional layers stacked upon the base layer.

11. The elongated protective barrier of claim 1, wherein:

at least one of the base layer or one or more of the plurality of additional layers is formed from strips of recycled tire tread.

12. The elongated protective barrier of claim 1, further comprising:

a plurality of clips connected to at least one of the plurality of additional layers or the base layer, and configured to couple the elongated protective barrier to the guardrail by clipping over the guardrail.

13. A protective barrier assembly comprising:

an elongated channel including an elongated base having a minimum width, first and second elongated outwardly tapered walls extending from the elongated base, and an outer opening having an outer opening width greater than the minimum width defined between the first and second elongated outwardly tapered walls;

a plurality of layers of rubberized material positioned in the elongated channel and stacked upon the elongated base, the plurality of layers of rubberized material including:

a base layer having a base layer width less than or equal to the minimum width of the elongated base; and at least one additional layer stacked upon the base layer, the at least one layer having a width greater than or equal to the base layer width and less than the outer opening width;

an outermost layer extending at least partially beyond the outer opening of the channel; and a plurality of fasteners extending through the plurality of layers of rubberized material and configured to fasten the plurality of layers of rubberized material to the elongated base of the elongated channel.

14. The protective barrier assembly of claim 13, wherein:

the at least one additional layer includes a first additional layer having a first additional layer width and a second additional layer having a second additional layer width; and the first additional layer width is greater than the base layer width and the second additional layer width is greater than the first additional layer width.

15. The protective barrier assembly of claim 13, wherein:

the width of the at least one additional layer is constant.

16. The protective barrier assembly of claim 13, wherein:

the width of each layer of the at least one additional layer varies between a first width and a second width; and the first width being greater than the base layer width and the second width being greater than the first width.

17. The protective barrier assembly of claim 13, wherein:

the outermost layer includes an outermost layer width greater than the outer opening width.

18. The protective barrier assembly of claim 13, wherein:

the outermost layer is formed from ground recycled rubber.

19. The protective barrier assembly of claim 13, wherein:

at least one layer of the plurality of layers of rubberized material includes at least one strip of recycled tire tread.

20. The protective barrier assembly of claim 13, wherein:

the base layer and the at least one additional layer are formed from strips of recycled tire tread.

21. The protective barrier assembly of claim 13, wherein:
the plurality of layers of rubberized material are connected together with an adhesive.

22. The protective barrier assembly of claim 13, wherein:
the plurality of layers of rubberized material include a plurality of aligned holes spaced along a lengthwise direction of the plurality of layers;
the plurality of aligned holes bisect respective widths of the plurality of layers of rubberized material; and
each hole of the plurality of aligned holes is configured to receive a fastener of the plurality of fasteners.

23. The protective barrier assembly of claim 13, wherein:
each layer of the plurality of layers of rubberized material includes a respective width varying according to a variable width of the elongated channel defined between the first and second elongated outwardly tapered walls.

24. The protective barrier assembly of claim 13, wherein:
each layer of the plurality of layers of rubberized material includes a first width and a second width;
the first width being substantially equal to a maximum width of an adjacent preceding layer; and
the second width being substantially equal to a minimum width of an adjacent succeeding layer.

* * * * *